US006574868B1

(12) United States Patent
Overholt

(10) Patent No.: US 6,574,868 B1
(45) Date of Patent: Jun. 10, 2003

(54) KNIFE WITH REPLACEABLE CUTTING ELEMENT

(76) Inventor: Steven D Overholt, 4275 D.J. Dr., Missoula, MT (US) 59803

( * ) Notice: Subject to any disclaimer, the term of this patent is extended or adjusted under 35 U.S.C. 154(b) by 0 days.

(21) Appl. No.: 09/517,536

(22) Filed: Mar. 1, 2000

(51) Int. Cl.[7] ..... B26B 5/00

(52) U.S. Cl. ..... 30/155; 30/156; 30/349; 30/329

(58) Field of Search ..... 30/349, 329, 337, 30/339, 156, 161, 155

(56) References Cited

U.S. PATENT DOCUMENTS

| | | | | | |
|---|---|---|---|---|---|
| 879,446 | A | | 2/1908 | Deneen | |
| 891,238 | A | | 6/1908 | Feinenburg | |
| 1,110,181 | A | | 9/1914 | Bitz | |
| 1,332,256 | A | | 3/1920 | Hart | |
| 1,426,184 | A | | 8/1922 | Hammar | |
| 1,467,434 | A | | 9/1923 | Kennedy | |
| 1,706,251 | A | * | 3/1929 | Perry | 30/337 |
| 1,782,901 | A | | 11/1930 | Kassel | |
| 1,822,050 | A | * | 9/1931 | Luedtke | 30/337 |
| 1,851,829 | A | | 3/1932 | Gonyk | |
| 1,888,488 | A | | 11/1932 | Brown | |
| 2,187,590 | A | | 1/1940 | Lurie | |
| 2,265,775 | A | * | 12/1941 | McNamara | 30/332 |
| 2,459,407 | A | * | 1/1949 | Beaver | 30/337 |
| 2,491,575 | A | * | 12/1949 | Nelson | 30/337 |
| 2,584,603 | A | | 2/1952 | McMillan et al. | |
| 2,610,401 | A | | 9/1952 | Vosbikian et al. | |
| 2,647,314 | A | | 8/1953 | Gilson | |
| 3,107,426 | A | | 10/1963 | Robinson, Jr. | |
| 3,306,297 | A | * | 2/1967 | Voorhess et al. | 30/329 |
| 3,670,415 | A | | 6/1972 | Rose | |
| 3,772,955 | A | | 11/1973 | Pearl | |
| 3,986,260 | A | | 10/1976 | Whiteford | |
| 4,180,909 | A | | 1/1980 | Lind | |
| 4,574,673 | A | | 3/1986 | Pearl | |
| 4,607,432 | A | | 8/1986 | Montgomery | |
| 4,712,364 | A | | 12/1987 | Oxley | |
| 4,890,388 | A | | 1/1990 | Rose | |
| 4,937,941 | A | | 7/1990 | Crist | |
| 5,027,516 | A | | 7/1991 | Howerton | |
| 5,116,351 | A | * | 5/1992 | Frassetti | 30/161 |
| 5,359,778 | A | | 11/1994 | Seber et al. | |
| 5,581,895 | A | | 12/1996 | Jeffcoat | |
| 5,689,889 | A | | 11/1997 | Overholt | |
| 5,937,527 | A | * | 8/1999 | Okada | 30/332 |
| 6,058,611 | A | * | 5/2000 | Rickard | 30/349 |

FOREIGN PATENT DOCUMENTS

| | | |
|---|---|---|
| DE | 27 18 638 | 11/1978 |

* cited by examiner

*Primary Examiner*—Kenneth E. Peterson
*Assistant Examiner*—Omar Flores-Sánchez
(74) *Attorney, Agent, or Firm*—Dowrey & Associates

(57) ABSTRACT

A knife having a handle component and a blade component, the blade component comprising a pair of opposed flanking side members and a replaceable blade insert confined and held therebetween. The side members are joined together by a blade insert locator and a spacer element at the region of connection to the handle so as to provide a slot forward of the handle for inserting the replaceable blade. The blade insert is configured to engage the blade insert locator and the spacer element so as to be held in the slot completely within the confines of the blade component. A blade insert locking structure is mounted on the blade component so as to be structurally and functionally independent of the handle component. The handle component and blade component may be of either the fixed or folding type and the blade insert may include a gut hook on its terminal end.

25 Claims, 6 Drawing Sheets

KNIFE WITH REPLACEABLE CUTTING ELEMENT

BACKGROUND OF THE INVENTION

1. Field of the Invention

The present invention relates to knives and, more particularly, to knives having replaceable cutting blades or cutting elements.

2. Description of the Prior Art

Knives and other cutting devices such as utility blade holders and the like having replaceable blades or cutting elements are well known in the prior art and various means of blade mounting, retention and disassembly have been proposed. The advantage of this type of knife or cutting device is the ability to rapidly replace the cutting edge either in the field, such as with a hunting or skinning knife, or during use on a job site. The dulled or damaged blades or cutting elements are usually disposable. This approach allows the user to maintain a superior cutting edge in the absence of sharpening implements or sharpening skills which may otherwise be required. The key to the success of such devices lies not only in the ease of blade replacement but also in the means whereby the replaceable blade is rigidly supported and locked to the cutting edge mounting portion of the cutting device.

Following are examples of cutting devices of the foldable or retractable blade type utilizing replaceable cutting elements.

| U.S. Pat. No. | Patentee |
|---|---|
| 1,467,434 | P. Kennedy |
| 1,782,901 | M. B. Kassel |
| 1,888,488 | R. E. Brown |
| 2,187,590 | A. J. Lurie |
| 3,107,426 | W. H. Robinson, Jr. |

Still other replaceable cutting element structures have been proposed in the prior art for use with fixed-blade knives. The following listed patents are illustrative of this type of structure.

| U.S. Pat. No. | Patentee |
|---|---|
| 3,986,260 | Whiteford |
| 4,180,909 | Lind |
| 4,574,673 | Pearl |
| 5,689,889 | Overholt |
| Germany | 2718638 11/1978 |

The following listed patents are cited as being of general interest for their showing of knives or cutting implements intended for field dressing and skinning animals utilizing a gut hook.

| U.S. Pat. No. | Patentee |
|---|---|
| 5,359,778 | Seber et al |
| 5,581,895 | Jeffcoat |

My prior U.S. Pat. No. 5,689,889 listed above discloses a novel structure wherein a blade replacement insert is disposed between spaced flanking side support members and is engaged with a blade insert locator means in position between the side support members forwardly of the knife handle. This allows the replacement blade to be inserted downwardly through a slot or opening provided by the spaced flanking side support members and moved into position to be retained by the blade insert locator means. The blade locator means, whether a single or multiple part element, includes a locating and locking edge contacted by the blade insert and about which the blade insert is pivoted or fulcrumed during insertion and a seating edge against which the blade insert comes to rest. With these two functions of the locator, the forward end of the blade insert is restrained against upwardly, downwardly, and forwardly directed forces which occur during use. Since the blade locator is contained in the forward portion of the blade component and is structurally separate from the blade insert lock, the locator is not limited to use with fixed blade knives and is equally applicable to foldable blade knives. The replaceable blade insert is locked against removal from between the side support elements by locking means cooperating with and contained within the handle structure. The blade, comprising the side support members, the replaceable blade insert and the blade insert lock thus becomes integrated with the handle in this fixed blade version, both in terms of blade insert replacement structure and function.

SUMMARY OF THE INVENTION

According to the present invention, a knife structure is provided which includes the usual blade and handle components, of either the fixed or foldable blade type, with the blade component having a replaceable cutting element or blade insert. In its broadest scope, the present invention contemplates the location of the replaceable blade insert as well as the blade locator means and blade insert locking means totally within the confines of the blade component, separate in both structure and function from the handle component and is not limited to any specific blade locator or blade insert locking means.

The blade component includes elongated side support members which extend forwardly from the handle component and flank the cutting element, the elongated replaceable cutting element being installed and removed by insertion and retraction from between the flanking side supports from the top side of the blade component. The side support members are laterally spaced and are joined together at a position forward of the handle by a blade insert locator means, thus providing a slot between the flanking side members for insertion of the replaceable blade. The blade insert locator means may be either a single or multiple part structure and the term will be expressly understood to refer to such in the present description and claims. The insert locator means provides a locating and locking edge or point initially contacted by the blade insert and about which the blade insert is fulcrumed during insertion and a seating edge or surface against which the blade insert comes to rest. These two structural features of the locator serve to lock the forward end of the blade insert against upwardly, downwardly and forwardly directed forces once it is assembled and locked into position for use.

The inner ends of the side support members are joined by a suitable spacer element providing a pivotal connection to a standard folding knife handle. In the alternative, the side support member and spacer may be extended to form a conventional tang section to the rear of the blade component which extends into the handle portion and may be fixed relative thereto in any manner well understood in the art.

Whether the blade component is adapted for a fixed or a folding knife structure, the blade insert is locked into final position between the two side support members by a blade insert locking structure contained wholly within the blade component, independently operable and structurally separate from the handle itself. With this arrangement, the blade component of a folding knife may remain in the locked open position thus allowing the blade insert to be replaced in a safe manner without the risk of closing against the user's fingers. This feature also provides for a more simplified blade and handle construction when utilized in either the fixed or foldable blade knife arrangement. The foldable blade knife may, of course, be of the lockable or un-lockable type. The fact that the blade insert locking mechanism does not depend upon or interfere with the handle structure accommodates the blade for use with any standard blade lock such as, but not limited to, spring-latch locks, linear locks or button locks. Additionally, since the blade insert lock is located along the upper edge of the side support members forward of the handle component, it does not interfere with movement of the blade relative to the handle in a folding knife structure. The blade insert lock may take any one of a number of configurations, the illustrated and described locking mechanism being a clamping bolt or pin arrangement which connects the inner end of the blade insert to the two side support members. In the alternative, such devices as slide locks, pivotal locks and locking pins of various configurations may also be used.

The blade insert is also provided in various configurations such as, but not limited to, an extended and pointed terminal end, or a blunt, flat or rounded terminal end, designed for various specialized uses. In one embodiment the blade insert incorporates a gut hook, either supported or unsupported by the side support members.

DESCRIPTION OF THE PREFERRED EMBODIMENT

The knife of this invention includes a handle component 10 and a blade component 11 with the blade component including a cutting portion extending forwardly from the handle component and an inner end portion for pivotal connection to the handle component 10. Although the present embodiment is illustrated and will be described as it applies to a foldable knife such as a pocket knife, wherein the blade portion is foldable back into the handle to a storage position, the invention is equally applicable to fixed-blade knife structures such as that shown in my prior U.S. Pat. No. 5,689,889. For such use, the blade component would include a tang or extended rear end section which is clamped between the side pieces of a handle such as a hunting knife or utility knife. The present invention is not to be limited to any particular style of knife.

Figure 1:
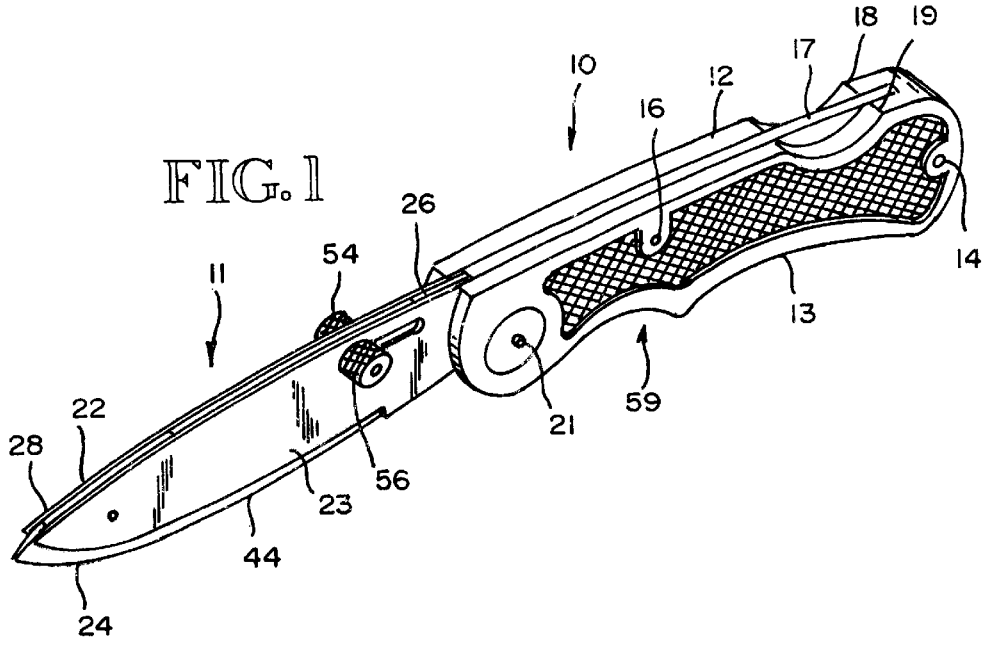
FIG. 1 is a perspective view of a folding knife embodiment of the present invention.
Figure 3:
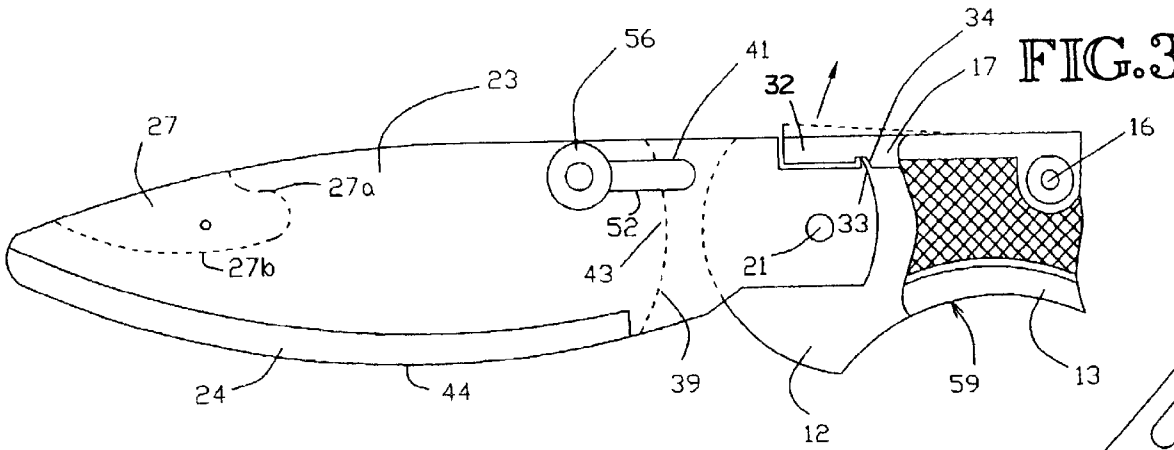
FIG. 3 is a side elevational view showing the blade lock connection between the folding blade and knife handle.

In the present illustrated embodiment, the knife handle component 10 may be any one of a number of foldable knife handles which normally includes, but is not limited to, the side grips 12 and 13. The side grips may be either a unitary construction or a multiple-piece assembly, such as shown in FIG. 1, held together by such means as the pins 14 and 16. These pins also serve to mount a spring biased blade latch 17 for engaging and locking the blade component in the open position as shown in FIGS. 1 and 3. It will be understood that the handle portion just described may take any one of a number of known prior art configurations such as that used in unlockable knives, liner locks or button locks. In the illustrated embodiment, the latch 17 is pivoted about the pivot point 16 and spring urged in the closed position shown in FIG. 3 by a leaf spring or other device (not shown) within the handle. The two side grips 12 and 13 will normally include aligned cut-out areas 18 and 19 respectively permitting access to the rear end of latch member 17. Pressure applied to the latch 17 at the cut-out areas serves to pivot the latch to the unlocked position shown in dotted lines in FIG. 3 so as to release the knife blade, allowing it to be folded to a storage position within the handle 10. A pivot pin 21 is located near the outer end of the handle and provides a pivotal attachment for the knife blade as will presently be described.

Figure 2:
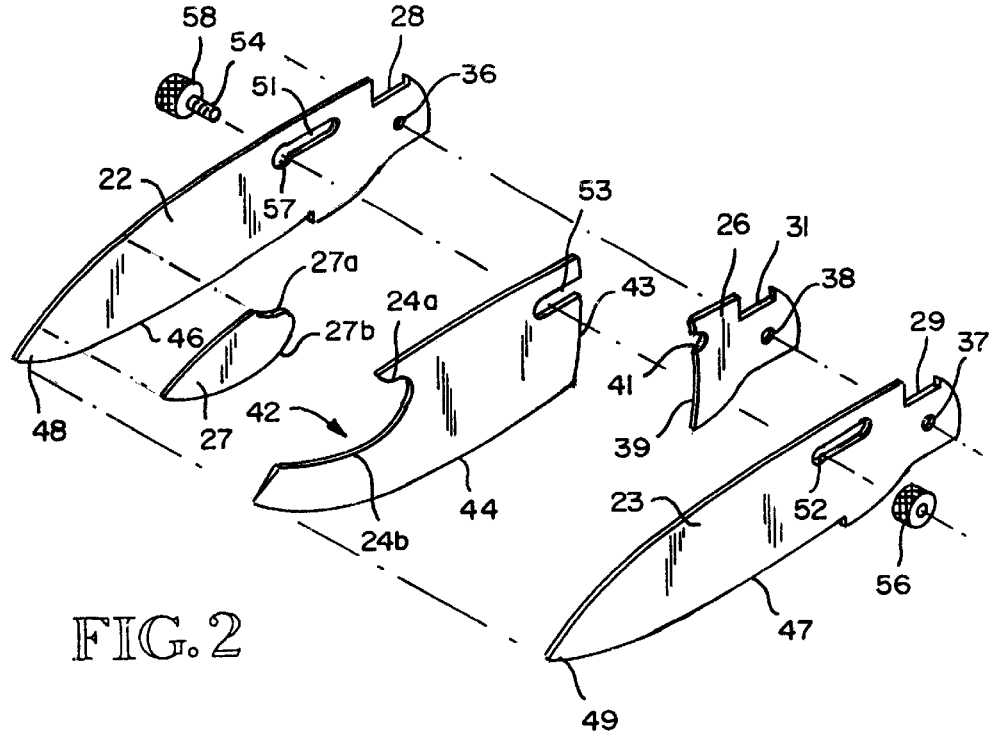
FIG. 2 is an exploded view of the blade component and replaceable cutting element assembly of the FIG. 1 embodiment.

Referring to FIG. 2, the blade component of the knife includes a pair of side support members 22 and 23 which flank an intermediate blade insert 24. The flanking side support members are held in spaced relationship by means of the blade spacer element 26, located at the pivotal end of the blade portion where it joins the handle, and a blade insert locator 27 positioned forwardly toward the outer end of the side support members. The spacer element 26 and the locator 27 will have a thickness substantially equal to the thickness of the blade insert 24.

The spacer element 26 is confined between the side support members 22 and 23 and has a peripheral outline generally conforming to the peripheral outlines of the rear end portions of the side members 22 and 23 as shown in FIGS. 2. This configuration includes the notches 28 and 29 in the side members 22 and 23 respectively and a corresponding notch 31 in the spacer. It will be appreciated, of course, that the particular arrangement of notches or other features may be altered dependent upon the type of blade lock utilized or to accommodate a non-lockable blade arrangement. In the assembled condition, the aligned notches 28–31 in the present embodiment are positioned to receive the keeper end portion 32 of the latch 17 to lock the blade component to the handle 10 in the open position. In this position, the upwardly protruding rear sides of the notches 28–31 form a rib 33, as seen in FIG. 3, which engages a suitable notch 34 in the latch 17 to securely lock the blade component in the open position. The side support members 22 and 23 and the spacer 26 are provided with holes 36, 37 and 38 which, when the members are assembled, align to receive the pivot pin 21 which connects the blade component to the handle. With this arrangement, the spring biased latching member 17 will hold the blade component in predetermined locked alignment with the handle 10. In order to release the blade component for pivoting about the pin 21 to a storage position within the handle, it is merely necessary to press downwardly on the latch 17 in the area of the notches 18 and 19 to release the latch against its spring bias, allowing the blade component to pivot into the handle. The structural arrangement described and illustrated is a common and well known latching means for pocket or pen knives. It will be understood that the locking system may be varied or modified as desired and that the invention is not limited to any specific blade locking or blade pivotal mounting arrangement. It is further understood that, since the replacement blade insert lock to be described is located entirely within the blade component, the present invention is equally well adapted to a fixed blade arrangement.

In the present embodiment, the spacer element 26 further includes a curved surface 39, providing a seat for the rear end of the blade insert 24, and a slot 41 for receiving a blade insert lock in the preferred embodiment as will be presently described. The flanking side support members 22 and 23, the spacer element 26 and the blade insert locator 27 may be attached to one another by any suitable means such as bonding by an adhesive or cement, or by being mechanically attached by any suitable means such as rivets, pins, welding or the like. This composite, along with the replaceable insert 24 and its locking means, comprises the blade component of the knife.

As previously mentioned, the locator 27 has a thickness substantially equal to the thickness of blade insert 24 and separates the forward ends of the flanking side support members 22 and 23. The locator 27, as previously described, may be a single element or a multiple element structure for providing a locating and locking fulcrum point for insertion of the blade insert and a blade insert seating edge or surface. In the present embodiment, the locator 27 has a rear end formed to provide a locating and locking edge 27*a* with the underside of the locator being formed to provide a blade insert seating edge 27*b*. Although the edge 27*a* and surface 27*b* are shown as portions of a continually curved surface, it will be understood that other configurations are possible as long as a locking point or edge is provided and a seating edge, compatible with the configuration of the blade insert, is provided. In the illustrated embodiment, the locator 27 may be positioned at a distance about ⅔ of the length of the side support members 22 and 23 from the handle component 10. The locator 27 is preferably positioned between the side support members 22 and 23 so that its top edge is flush with the top edges of the side members. With the parts assembled, this provides a relatively smooth continuous surface for the top edge of the blade component.

Figure 4:
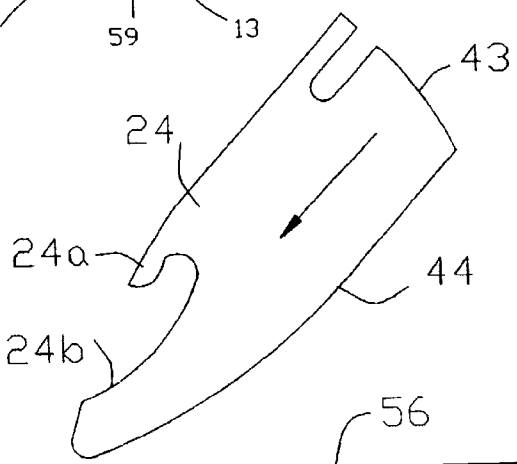
FIGS. 4–6 are partial side elevational views of the tip portion of the FIG. 1 knife blade illustrating in sequence the insertion of the replaceable cutting element between the flanking side support members.
Figure 4:
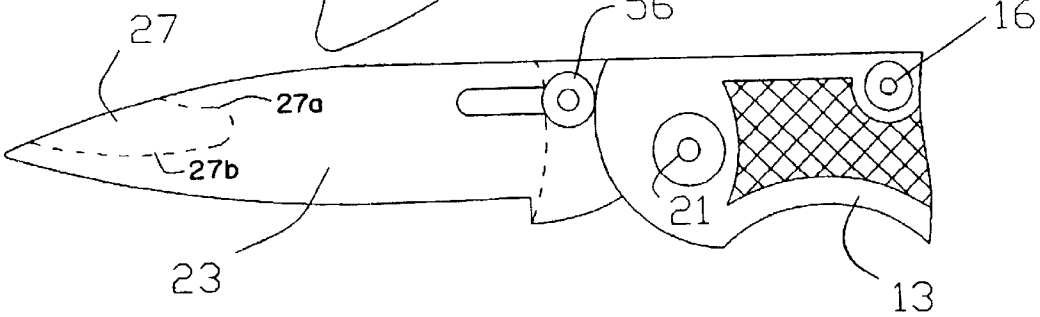
Figure 5:
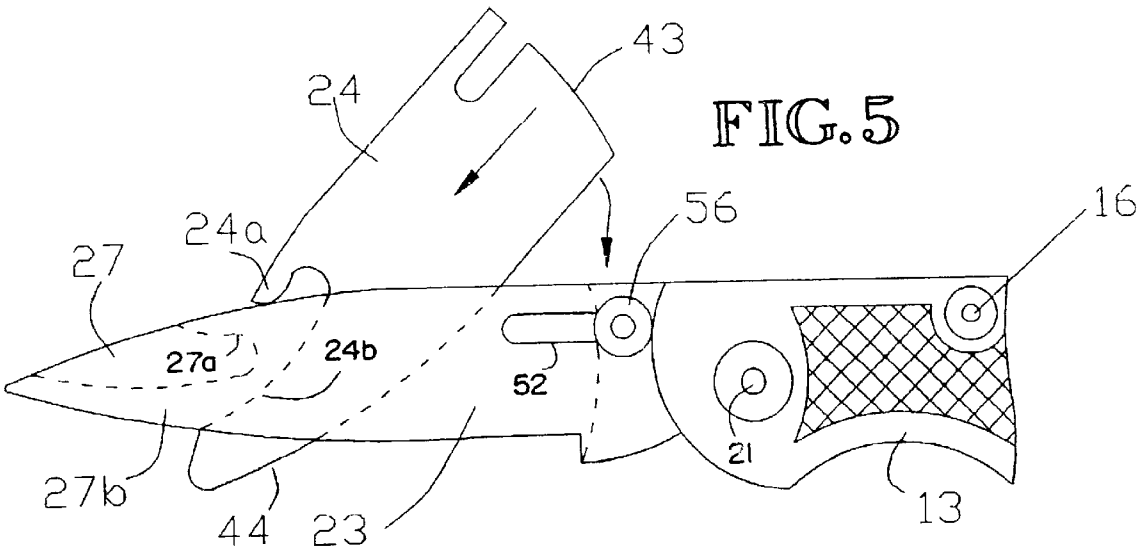
Figure 6:
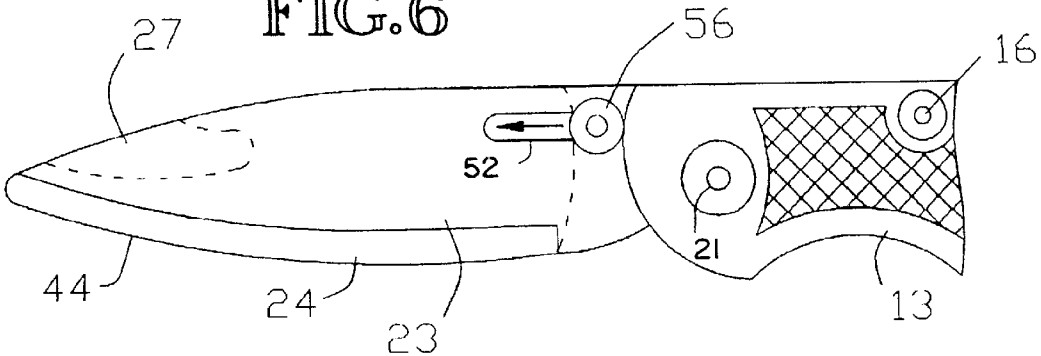

The blade insert 24 illustrated most clearly in FIG. 2 is provided with a cut-out 42 shaped so that it has a forwardly pointing rear projection 24*a* and a bottom edge 24*b*. Projection 24*a* is shaped to mate with the locator locking edge 27*a*, and bottom edge 24*b* is shaped to mate with the locator blade seating edge 27*b*, respectively. As a consequence of the matching configurations of projection 24*a* with the locking edge 27*a*, and the bottom edge 24*b* with blade seating edge 27*b*, the blade insert 24 may be placed between the flanking side support members 22 and 23 and the cut-out 42 engaged with the locator 27 to both locate the blade insert 24 in its proper location and to lock the blade insert 24 within the blade component. FIGS. 4–6 illustrate, in sequence, the placement of the blade insert 24 between the flanking side members 22 and 23 and the locking of the blade insert to the locator 27. As the blade insert 24 is placed between the flanking side members 22 and 23, tip first from the top of the blade component, the cut-out projection 24*a* is engaged and allowed to pivot about the locking edge 27*a* so that the blade insert may be pivoted about the locator 27 until the blade insert is fully aligned with the side members and seated on the locator surface 27*b*. When the blade insert is fully aligned with the flanking side members 22 and 23, the top edge of the blade insert will be flush with the top edges of the side members as shown in FIGS. 1 and 6 and the edge of the cut-out 42 will completely abut the edge of the locator 27 as shown in FIG. 6. Removing the blade insert 24 can be achieved by reversing the sequence of the procedure shown in FIGS. 4–6.

When the blade insert 24 is fully engaged with the locator 27 as shown in FIGS. 3 and 6, the blade insert is locked into its relationship with the flanking side support members 22 and 23 and the locator 27 against upwardly, downwardly and forwardly directed forces as previously described. When fully engaged with the locator 27, the blade insert 24 is also locked against rearwardly and downwardly directed forces as a result of the engagement of the rear end surface 43 of the blade insert with the seating surface 39 of the spacer element 26. The rear end surface 43 of the blade insert is curved so as to conform to the curved seating surface 39 of the insert 26 so as to seat thereagainst when the blade insert 24 is placed in its operative position shown in FIGS. 3 and 6. Since the engagement of the insert 24 with the locator 27 prevents forward movement of the insert, the insert is blocked from further downward movement relative to the spacer 26.

The flanking side members 22 and 23 as well as the spacer element 26 and the blade insert locator 27 may be fabricated of a durable, reasonably stiff metal, such as tungsten carbide or stainless steel. Alternately, they may be fabricated from cast steel or bronze, or a suitable engineering plastics material such as fiberglass-filled or graphite-filled, nylon or polyurethane, and they may be reinforced with graphite fiber laid along the length of the side members. Any combination of these materials is, of course, possible. Likewise, any known means of fabrication such as injection molding or other forming processes may be used to fabricate these parts. The flanking side members 22 and 23 are shaped to have a peripheral outline similar in pattern to the blade insert 24, except that the depth of the side members is sufficiently less than the depth of the blade insert so as to adequately expose the cutting edge 44 of the insert. The inner surfaces of the side members 22 and 23 are parallel and co-planar with the outer surfaces of the blade insert 24 so that the portion of the blade insert that is confined between the side members will abut and be supported by the side members inner surfaces. The outer surfaces of the side members may be shaped to taper to a very narrow lower or bottom edge so that the transition from the blade insert 24 to the outer surface of each side member is streamlined. To the touch, the lower edges 46 and 47 of the side members 22 and 23 respectively would feel sharpened and the transition from the blade insert to each side member would be relatively imperceptible. The tips 48 and 49 of the side members 22 and 23 respectively would likewise be tapered to a fine edge for transition purposes.

The blade insert 24 is preferably fabricated from any material that retains a sharp edge, such as material from which ceramic blades or razor blades are formed. The side surfaces of the blade insert 24 are parallel and co-planar. The blade insert 24 is formed as a thin strip of such material that has a sharpened edge 44 applied after it has been formed. The sharpened edge 44 can be formed in any desired configuration, such as v-shaped, serrated, or beveled to provide a single cutting taper, and the like. The sharpened edge may be honed with a sharpening steel without substantially changing the edge bevel. Likewise, the terminal or outer end of the blade insert may be formed with a sharp point or may be blunted, rounded or even flat to serve any desired purpose or use. When the blade insert 24 becomes excessively worn, due to resharpening, it may be removed and replaced. Of course, a dull blade insert may be removed and replaced regardless of whether it has ever been resharpened.

The structure thus far described provides for the insertion, seating and locking of the blade insert member against upwardly directed forces on the forward part of the blade component as well as downwardly and forwardly directed forces, all within the confines of the blade component completely separate, both in structure and function, from the handle component. In order to lock the blade insert from removal, once it has been seated as illustrated in FIGS. 1, 3 and 6, a blade insert locking means is provided which is also contained wholly within the blade component, completely separate, both structurally and functionally, from the handle component and the blade locking mechanism of the handle. In the preferred embodiment of FIGS. 1–6, the blade insert locking means is provided by the elongated slots 51 and 52 in the side members 22 and 23 respectively which are in alignment when the side members are in the assembled position. The blade insert 24 is likewise provided with a slot 53 which registers with the slot 41 in the spacer 26 so as to be aligned with the slots 51 and 52 when the composite blade component, including the blade inserts is assembled. It will be noted that the partial slot 41 in the seating surface 39 of the spacer 26 is completely separate from the handle component and may be spaced forwardly therefrom. In order to lock the insert 24 from removal once it has been seated, an insert locking member is engaged within the slots 51–53. In the illustrated embodiment, the threaded bolt 54 and clamping nut 56 are mounted in the aligned slots 51–53. In the locking position, the bolt 54 is located forwardly in the slots 51–53 as shown in FIGS. 1 and 3 and the nut 56 is tightened to hold the locking bolt member in the locking position. When it is desired to replace the blade insert 24, the nut 56 is loosened and the bolt is slid along the aligned slots toward the handle so as to rest at the opposite end thereof and within the partial slot 41 of the spacer 26 as shown in FIGS. 4–6. In this position, the insert 24 may be removed and replaced, reversing the steps illustrated in FIGS. 4–6. In order to remove the blade insert, it is merely necessary to rest the rear end of the sharpened edge 44 on a hardened surface and press downwardly to raise the rear end of the insert. With the bolt 54 located within the rear end of the slot and within the spacer slot 41, the insert 24 may be freely lifted upwardly and removed. With the structural arrangement described, it will be seen that the blade component 11 may remain in the locked open position, relative to the handle 10, during replacement of the blade insert 24 without fear of the blade closing on the user's fingers. The bolt 54 and nut 56 do not interfere with or depend on the handle component and, in the closed position of the folding knife, will be located so as to clear the handle. The locking bolt and nut may be located on a raised section on the top edge of the blade configuration or, in some instances, may be accommodated by the existing handle contour, such as the recess 59 on the bottom side of the handle. The protruding bolt and nut heads also provide a convenient finger hold for grasping the blade back when opening the knife.

Referring to FIG. 2, the forward end of the slot 51 in the side member 22 may be formed with an increased diameter as at 57 so as to receive a shoulder 58 of substantially matching diameter on the bolt 54. The purpose of the engagement between the shoulder 58 and the increased diameter end portion 57 of the slot is to prevent accidental sliding of the locking bolt from the forward position to the rear release position during use. It would be possible, of course, to reverse the arrangement and locate the increased diameter area 57 and the bolt 54 on the opposite side support member 23. In the alternative a shoulder could be located on the nut or the entire diameter of the nut or bolt head could be sized to drop into the opening 57. It is to be understood that the specific nut and bolt locking arrangement has been described for purpose of illustration only and that any configuration of locking or clamping member or fastener may be substituted to hold a cross member in the locked position in the aligned slots.

Figure 7:
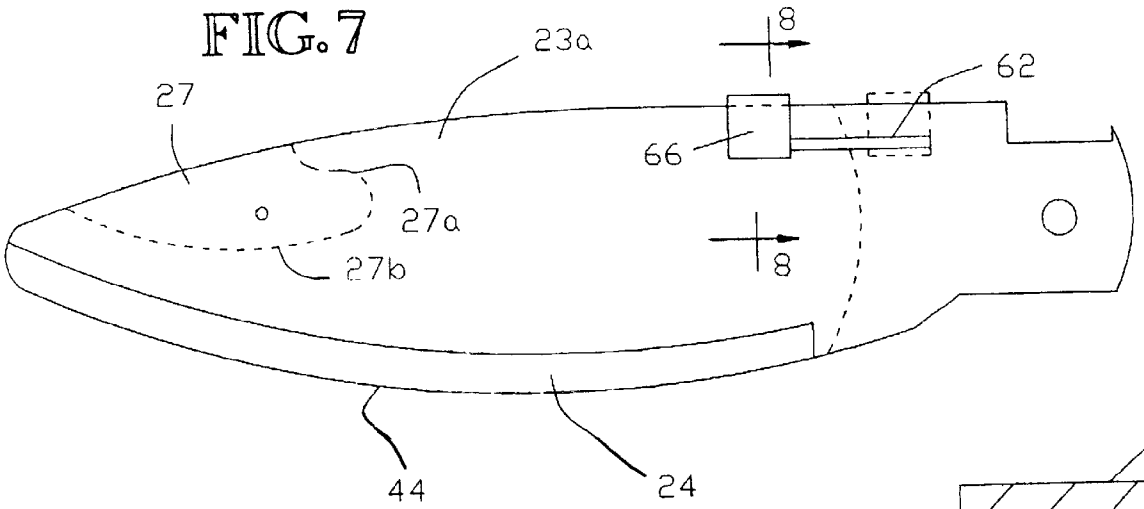
FIG. 7 is a partial side elevational view of the blade component and a slidable blade insert lock.

FIG. 7 illustrates an alternate form of blade insert lock and it will be understood that, except for the existence of slots in the blade insert and spacer, the composite blade component may be the same as that described for FIGS. 1–6. In the FIG. 7 embodiment, the side support elements 22*a* and 23*a* are provided with elongated grooves 61 and 62 respectively, designed to receive guide ribs 63 and 64 respectively of the inverted U-shaped slide lock 66 located on the top edge of the knife blade component. In the forward position of the slide lock 66 shown in FIG. 7, removal of the blade insert is blocked. For removal of the blade insert, the slide lock 66 will be moved to the rear, toward the knife handle component, as shown in dotted lines in FIG. 7 to allow the replacement blade to be withdrawn from between the side support members as previously described. The slide lock 66 may be made of either metal or non-metal material as desired. It will also be noted that, in this embodiment, the spacer element 26 will not need to be slotted. It will also be appreciated that the grooves 61 and 62 may actually comprise through slots in the side support members if desired. Likewise the order of arrangement of the slots 61–62 and ribs 63–64 may be reversed without departing from the innovative concept.

Figure 8:
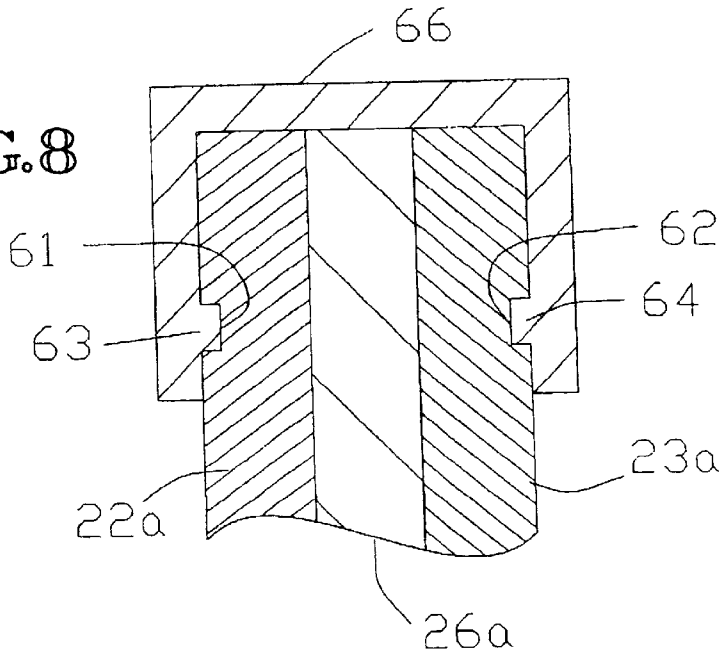
FIG. 8 is a cross section view taken along lines 8—8 of FIG. 7.
Figure 9:
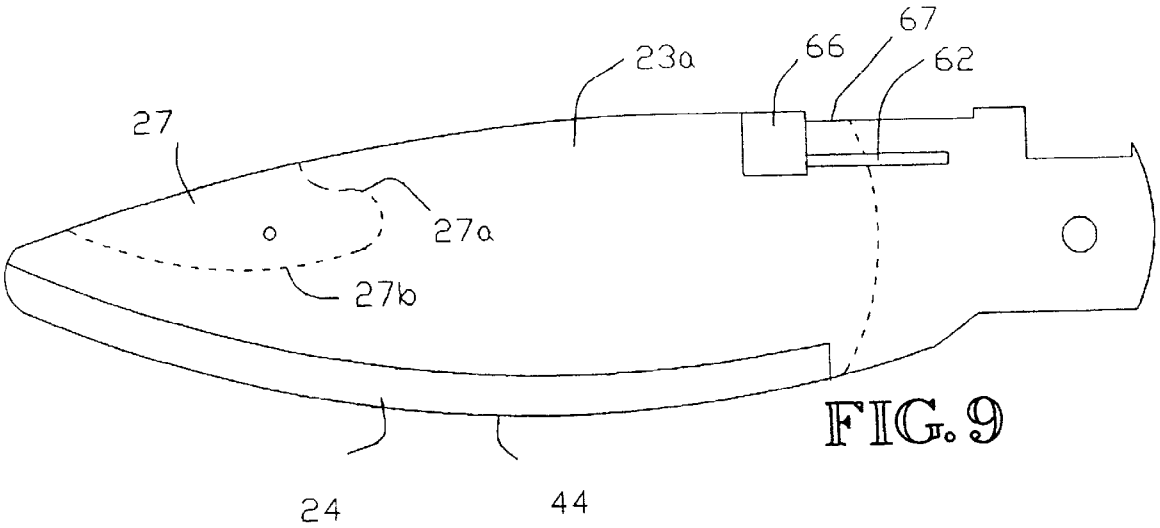
FIG. 9 is a view similar to FIG. 7 showing an alternate form of the FIG. 7 blade insert lock.

FIG. 9 illustrates an embodiment similar to the FIGS. 7–8 embodiment wherein the slide lock 66 is located in an elongated notch 67 formed in the side support members, spacer element and the rear top edge of the blade insert. With this arrangement, the top surface of the slide lock 66 may be made flush with the top edge of the blade component. It is also to be noted that the slide lock members 66 in the FIGS. 7–9 embodiments provide a convenient finger hold for grasping the blade back when opening the knife.

Figure 10:
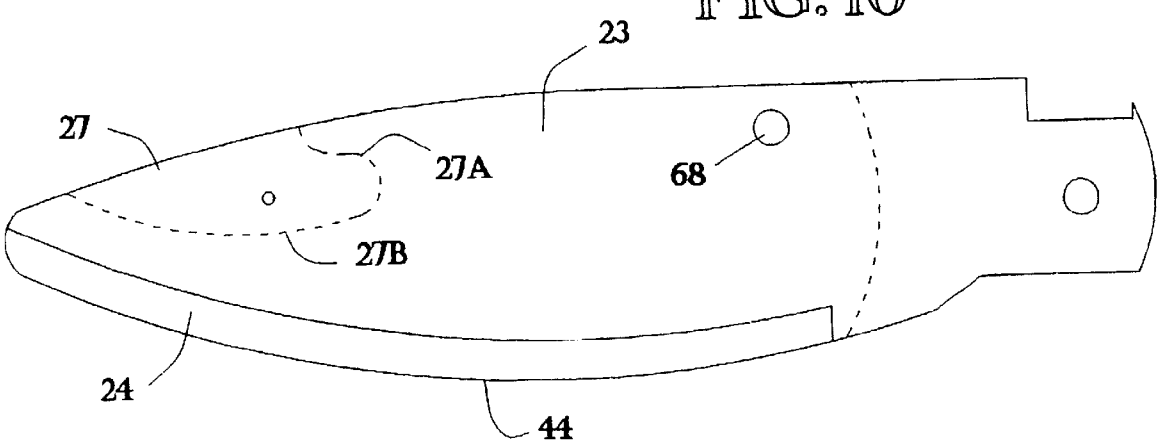
FIG. 10 is a side elevational view of the blade component showing a third type of blade insert lock.

FIG. 10 illustrates still another embodiment of the blade insert lock wherein the blade insert may be locked in position between the side support members by means of a removable locking pin or bolt 68. The locking pin or bolt 68 may be flush with the side support element surfaces or may protrude therefrom if desired and may be formed from either metallic or non-metallic material. The locking pin or bolt may be held in position by such means as a snug fit or by any other means such as a detente, screw threads or other rotational or slidable locking means.

Figure 11:
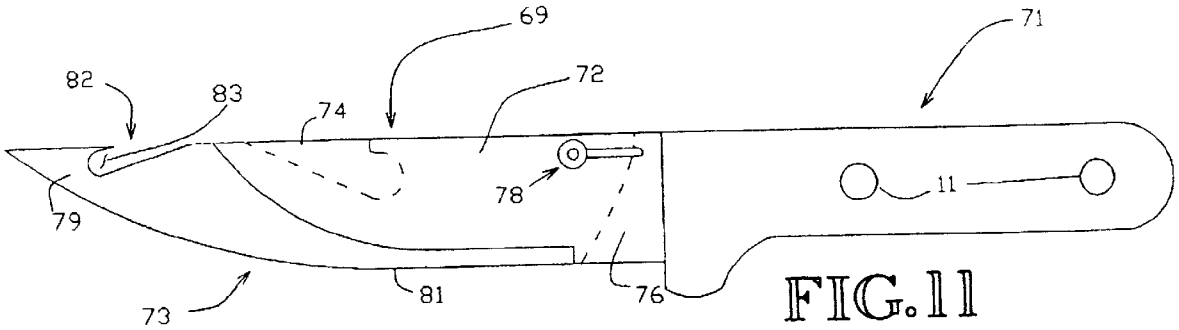
FIG. 11 is a side elevational view of a fixed blade knife of the present invention with the blade insert incorporating a gut hook.

FIG. 11 illustrates a fixed blade embodiment of the present invention which also includes a gut hook feature embodied in the blade insert. In this embodiment, the blade component 69 is rigid with the handle component 71. The blade component includes side support elements 72, one of which is shown in FIG. 11, and it will be understood that the blade component includes two such side elements arranged to provide a vertical slot for insertion of a replaceable blade insert 73 in the manner previously described in the FIG. 1–6 embodiment. The side support members are held in spaced relationship by means of the blade insert locator 74 and a rear spacer element 76. The side support members and the rear spacer element 76 in this embodiment will extend rearwardly forming a tang section which may be received in the handle component 71 and held there by pins or rivets 77. This connection may be any one of many known knife handle and blade assemblies including clamped side members or a single molded handle piece. In this embodiment, it will be understood that the side members 72, the rear spacer element 76 and the insert locator 74 function to provide for reception of the blade insert 73. The blade insert 73 will be locked between the side support elements 72 by means of the blade locking assembly 78 which may be in all respects identical to the nut, bolt and slot arrangement shown in FIGS. 1–6, or alternatively, insert locking means such as shown in FIGS. 7–10. It is important to note that, the blade insert and insert locking means are maintained completely separate from the structure of the handle component 71 as previously described. The blade insert 73 extends outwardly from the terminal ends of the side support members 72 to form a pointed outer terminal cutting end which includes a cutting edge 81 in a manner previously described. The pointed end portion 79 of the blade insert is unsupported by the side support members 72 and includes a gut hook 82 in the form of a forwardly extending notch in the top edge of the blade insert. The gut hook functions as a tool designed for cutting the skin or hide of an animal during field dressing without penetrating the membrane between the hide and the meat or between the hide and the visceral lining. This operation and function of the "gut hook" is well understood by those versed in the art. In this configuration, the gut hook section will be sharpened around the front and bottom radii 83 to provide a knife like surface for severing the hide or skin of an animal. It will be understood, of course, that in this embodiment the blade insert 73 will be fabricated from sufficiently rigid material to prevent excessive flexing or bending of the extended pointed end 79 of the insert.

Figure 12:
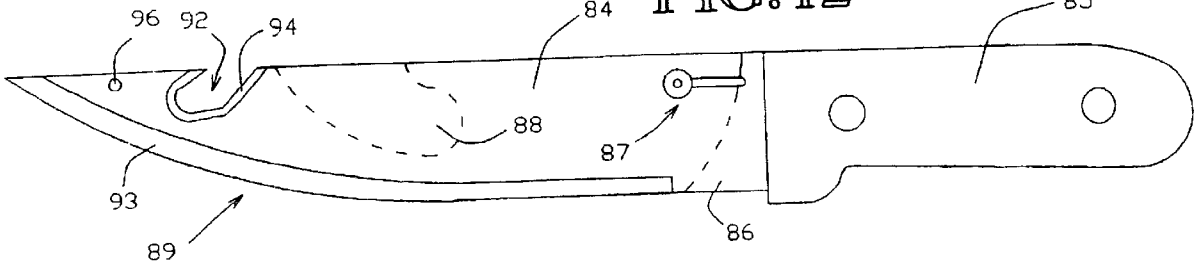
FIG. 12 is a side elevational view of a fixed blade knife of the present invention with the blade insert incorporating a gut hook supported by side support members.
Figure 13:
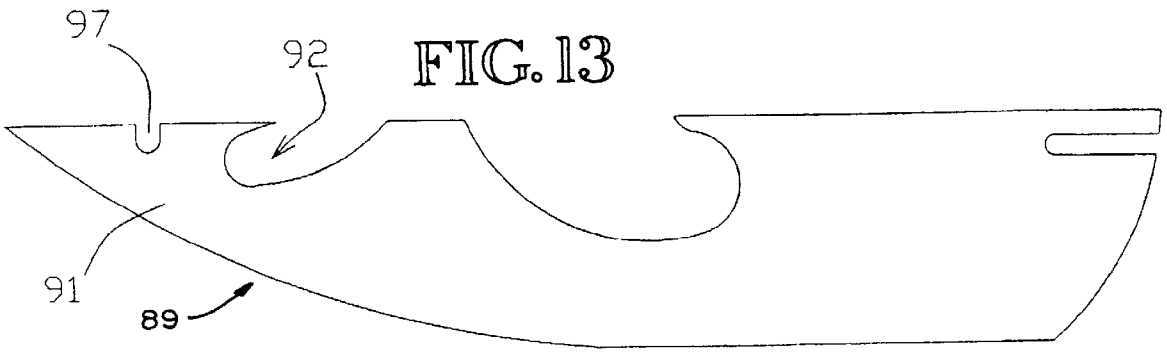
FIG. 13 is a side elevational view of the blade insert of the FIG. 12 embodiment.

FIGS. 12 and 13 illustrate a second embodiment of the fixed blade knife wherein the gut hook section of the blade insert is laterally supported by the side support members. In this embodiment, it will be understood that the side support members 84 and the spacer 86 cooperate with the handle component 85 in the same manner as described for the FIG. 11 embodiment. Also, the insert lock assembly 87 and the insert locator 88 function in the same manner as previously described. The blade insert member 89 as shown in detail in FIG. 13 includes the pointed end 91 having the gut hook notch 92 similar to the end 79 and hook 82 of the FIG. 11 embodiment and may be sharpened in the same manner as described at 83 in FIG. 11. In the FIG. 12 embodiment the side support members 84 extend outwardly in contact with the pointed end 91 of the blade insert to provide lateral support. The members 84 will be configured so as to leave the cutting edge 93 of the blade insert and the cutting edge 94 of the gut hook exposed for the cutting function. In this regard, the edges of the side support members will be tapered so as to provide a smooth transition into the surface of the cutting edges of the associated portions of the blade insert as previously described. Additionally, a spacer pin 96 may be mounted in the side support members to support and hold the members 84 together if desired. If the pin is used, a notch 97 may be provided in the insert 89 to accommodate the pin 96.

Although the FIGS. 11–13 embodiment have been illustrated and described as applied to a fixed blade knife, it will be understood that the gut hook feature, either supported or unsupported, applies equally well to the folding knife structure such as described in FIGS. 1–6.

While the preferred embodiments of the invention have been described herein, variations in the design may be made. For example, where certain drawings reflect a design suitable for right-hand use, the same principles could be applied to provide a left-hand version. Various other locking means are possible to secure the blade insert within the blade component as, for instance, pivoting latch plates, fasteners or keeper elements. The scope of the invention therefore is only to be limited by the claims appended hereto.

What is claimed is:

1. A knife having a handle component and a blade component connected thereto, said blade component terminating in a forward end distal from said handle, said blade component comprising a pair of elongated opposed flanking side members and a replaceable blade insert confined and held therebetween for lateral support; said blade insert having a forward end adjacent the forward end of said blade component and having a rear end close to said handle but spaced therefrom; said side members being joined together by blade insert locator means adjacent said forward end so as to provide a slot for insertion of said blade insert, said blade insert being configured to pivotally engage with said blade insert locator means so as to be held in place in said slot; a spacer element at the junction between the blade and handle components for seating the rear end of said blade insert, and blade insert locking means on said blade component and located between the blade insert locator and said handle component for locking said blade insert within said slot, said blade insert locking means being carried by said blade component so as to be structurally and functionally separate from said handle component.

2. The knife of claim 1 wherein said blade insert locking means comprises a locking element carried on said side members, said locking element being movable to a first position in contact with said blade insert and said side members to prevent relative movement therebetween and a second position out of contact with the blade insert to permit removal thereof.

3. The knife of claim 2 wherein said locking means includes aligned openings in said side members extending forwardly from said handle component; said blade insert including an opening therein aligned with the openings in said side members when the blade insert is held in said slot, said locking element extending through the openings in said side members and moveable into the opening in said blade insert in said first position to prevent relative movement therebetween.

4. The knife of claim 2 wherein said locking element is mounted for sliding movement along said side members between said first and second positions, and interfitting guide elements acting between said locking element and said side members for guiding movement of the locking element relative to the side members.

5. The knife of claim 4 wherein said side members include top edges flush with said blade insert and said locking element comprises a U-shaped member including a locking surface which extends between the top edges of said side members and overlies the blade insert when in the first position.

6. The knife of claim 1 wherein said blade component is connected to said handle component by a pivotal connector, said components being moveable between a substantially longitudinally aligned open position and a folded position with the blade component received within the handle component.

7. The knife of claim 6 including a blade lock acting between said components for locking the blade in the open position.

8. The knife of claim 6 wherein;

said side support members include terminal ends extending outwardly beyond said insert locator, said blade insert including a cutting end extending outwardly beyond said side support members, and a gut hook formed in the top edge of said blade insert cutting end.

9. The knife of claim 8 wherein;

said gut hook includes a curved cutting edge, and said side support members extend outwardly in contact with the blade insert adjacent said gut hook to provide lateral support for said cutting end, said side support members including cut out surfaces spaced from the cutting edge of said gut hook.

10. The knife of claim 1 wherein;

said side support members include terminal ends extending outwardly beyond said insert locator, said blade insert including a cutting end extending outwardly beyond said side support members, and a gut hook formed in the top edge of said blade insert cutting end.

11. The knife of claim 10 wherein;

said gut hook includes a curved cutting edge, and said side support members extend outwardly in contact with the blade insert adjacent said gut hook to provide lateral support for said cutting end, said side support members including cut out surfaces spaced from the cutting edge of said gut hook.

12. A knife having a handle component and a blade component connected thereto, said blade component comprising a pair of opposed flanking side members and a replaceable blade insert confined and held therebetween; said side members being joined together by blade insert locator means so as to provide a slot for insertion of said blade insert, said blade insert being configured to engage with said blade insert locator means so as to be held in place in said slot, and blade insert locking means located on said blade component for locking said blade insert within said slot, said blade insert locking means comprising a locking element and aligned openings in said side members extending forwardly from said handle component, said blade insert including an opening aligned with the openings in said side members when the blade insert is held in said slot, a spacer element in the area of the connection between the blade component and the handle component, said spacer element including an opening therein aligned with the openings in each said side members, said locking element extending through the openings in said side members and moveable to a first position into the opening in said blade insert to prevent relative movement therebetween and a second position into the opening in said spacer element and out of contact with the blade insert to permit removal thereof said blade insert locking means being carried by said blade component so as to be structurally and fictionally separate from said handle component, and clamping means to retain said locking element in said first position.

13. The knife of claim 12 wherein said locking element comprises screw threaded clamping means having an engaged position to hold the locking element in the first position and a released position to allow removal of the blade insert.

14. The knife of claim 13 wherein the locking element includes an enlarged area for engaging at least one of said side members, the side member in contact with said enlarged area including a recess conforming to the contour of said enlarged area when the locking element is in said first position to prevent accidental movement of the locking element.

15. The knife of claim 12 wherein said spacer element includes a seating surface for engaging said blade insert to prevent downward movement thereof when the insert is engaged with said blade insert locator means.

16. The knife of claim 12 wherein said blade component is connected to said handle by a pivotal connector, said blade and handle components being moveable between a substantially longitudinally aligned open position and a folded position with the blade component received within the handle component.

17. The knife of claim 12 wherein said pivotal connector passes through said spacer element.

18. The knife of claim 16 including a blade lock acting between said components for locking the blade in the open position.

19. In a knife having a handle component and a forwardly extending blade component connected thereto and terminating in a forward end distal from said handle, said blade component comprising;

elongated parallel flanking side members, a replaceable blade insert having a forward end adjacent the forward end of said blade component and a rear end with a cutting edge therebetween, said rear end being close to said handle but spaced therefrom, spacing means to hold said side members in spaced relation forming a slot therebetween for receiving said blade insert, said spacing means including a blade insert locator connecting said side members adjacent the forward end thereof and spaced from said handle component and a spacer element at the junction between the blade and handle components for seating the rear end of the blade insert, said blade locator including a pivot surface for contacting the forward end portion of said blade insert to enable downward rotational movement of the insert between said side members for seating on said spacer element, said blade insert being positioned and held in place in said slot by said insert locator with the cutting edge thereof extending along said side members and exposed beyond the peripheral edges of said side members, and blade insert looking means carried by said blade component to lock the blade insert against relative movement therebetween, said locking means being moveable between a locking position and a release position to enable removal of said blade insert, said blade insert locking means being carried by said blade component between the blade insert locator and said handle component, separate structurally and functionally from said handle component.

20. The structure of claim 19 wherein said blade component is pivotally connected to the blade component, said blade component being moveable between an open position and a closed position with said handle.

21. The knife of claim 20 including a blade lock acting between said components for locking the blade in the open position.

22. The structure of claim 19 wherein said blade insert locking means comprises a pin and slot connection between side members and said blade insert.

23. The structure of claim 22 wherein said blade insert locking means further includes clamping means for holding said pin in the locking position.

24. A knife having a handle component and a blade component connected thereto, said blade component comprising a pair of opposed flanking side members and a replaceable blade insert confined and held therebetween; said side members being joined together by a blade locator means spaced from said handle component so as to provide a slot for insertion of said blade insert, said blade insert being configured to engage with said blade insert locator means so as to be held in place in said slot; and blade insert locking means located on said blade component for locking said blade insert within said slot, said blade insert locking means including aligned elongated openings in said side members and said blade insert extending forwardly from said handle component and a locking pin slidably mounted in said elongated openings for movement between a forward position locking said side members and said blade insert against relative movement and a rearward position for releasing said blade insert, and means to fix said locking pin against said side support members in the forward position.

25. The knife of claim 24 wherein said locking pin comprises a screw threaded connector with a screw threaded keeper for holding said connector in the forward locking position.

* * * * *

UNITED STATES PATENT AND TRADEMARK OFFICE

CERTIFICATE OF CORRECTION

PATENT NO. : 6,574,868 B1
DATED : June 10, 2003
INVENTOR(S) : Steven D. Overholt It is certified that error appears in the above-identified patent and that said Letters Patent is hereby corrected as shown below:

Column 11,
Line 65, change "fictionally" to read -- functionally --

Column 12,
Line 55, change "looking" to read -- locking --

Signed and Sealed this

Seventh Day of October, 2003

JAMES E. ROGAN
*Director of the United States Patent and Trademark Office*